United States Patent [19]

Aizawa et al.

[11] 4,233,386

[45] Nov. 11, 1980

[54] METHOD OF REMOVING RESIDUAL TONER FROM SURFACE OF PHOTOCONDUCTIVE MEMBER FOR USE IN ELECTROSTATIC COPYING APPARATUS OF THE TRANSFER TYPE

[75] Inventors: Tatsuo Aizawa; Nobuhiko Kozuka, both of Osaka; Yuji Hasegawa, Hyogo, all of Japan

[73] Assignee: Mita Industrial Co., Ltd., Osaka, Japan

[21] Appl. No.: 942,379

[22] Filed: Sep. 14, 1978

[30] Foreign Application Priority Data

Sep. 19, 1977 [JP] Japan ..... 52-112830

[51] Int. Cl.[3] ..... G03G 13/14; G03G 15/00; G03G 15/06

[52] U.S. Cl. ..... 430/125; 15/1.5 R; 15/256.52; 118/652; 134/1; 355/15

[58] Field of Search ..... 355/15; 118/652; 15/1.5, 256.51, 256.52; 430/125, 109; 134/1, 6

[56] References Cited

U.S. PATENT DOCUMENTS

| | | | |
|---|---|---|---|
| 3,884,572 | 5/1975 | Bacon et al. | 15/1.5 R |
| 3,914,045 | 10/1975 | Namiki et al. | 355/15 |

*Primary Examiner*—R. L. Moses

*Attorney, Agent, or Firm*—Wenderoth, Lind & Ponack

[57] ABSTRACT

A cleaning method is provided for electrostatic copying apparatus of the transfer type in which a polarizable magnetic toner is used as a developer to remove residual toner from the surface of a photoconductive member after the transfer of toner images. The method comprises the steps of charging the toner remaining on the surface of the photoconductive member to the same polarity as the charge for sensitizing the surface of the photoconductive member after the transfer of a toner image, uniformly exposing the photoconductive surface simultaneously with or after the charging step, and thereafter removing the residual toner from the photoconductive surface by magnetic attraction.

4 Claims, 8 Drawing Figures

METHOD OF REMOVING RESIDUAL TONER FROM SURFACE OF PHOTOCONDUCTIVE MEMBER FOR USE IN ELECTROSTATIC COPYING APPARATUS OF THE TRANSFER TYPE

BACKGROUND OF THE INVENTION

The present invention relates to a method of cleaning the surface of a photoconductive member in an electrostatic copying apparatus of the transfer type in which a polarizable magnetic toner is used as a developer, and more particularly to a method of removing residual magnetic toner from the photoconductive surface after the transfer of toner images.

Various cleaning methods are known for electrostatic copying apparatus in which a magnetic brush is used for a magnetic toner having a polarity as disclosed in Japanese Patent Application Disclosures No. 122938/1975, No. 76932/1977. These known methods mainly utilize the electrostatic attraction acting between the magnetic toner and the magnetic brush and produced by a bias potential having a polarity opposite to that of the toner and given to the brush, while utilizing an electrostatic repelling force produced between the surface of the photoconductive member and the toner by a charge having the same polarity as the toner and given to the photoconductive surface.

However, the polarizable magnetic toner for which the method of this invention is used is not removable in the same manner as in the conventional cleaning method for a magnetic toner having a polarity in which the polarity of the toner itself is utilized. Moreover, when the photoconductive surface is charged, the toner on the magnetic cleaning brush will be polarized again by the charge on the photoconductive surface and attracted to the surface. Thus the surface of the photoconductive member can not be cleaned.

SUMMARY OF THE INVENTION

The main object of this invention is to provide a method of cleaning the surface of a photoconductive member in an electrostatic copying apparatus of the transfer type in which a polarizable magnetic toner is used as a developer, the method being adapted to easily and reliably remove residual toner from the photoconductive surface after the transfer of toner images onto copy paper.

In an electrostatic copying apparatus of the transfer type in which images of polarizable magnetic toner electrostatically formed on the surface of a photoconductive member are transferred, the above object can be fulfilled by a method of removing residual toner from the surface of the photoconducvtive member comprising the steps of charging the toner remaining on the surface of the photoconductive member to the same polarity as the charge for sensitizing the surface of the photoconductive member after the transfer of a toner image, uniformly exposing the photoconductive surface simultaneously with or after the charging step and thereafter removing the residual toner from the photoconductive surface by magnetic attraction.

DESCRIPTION OF THE PREFERRED EMBODIMENTS

Figure 1:
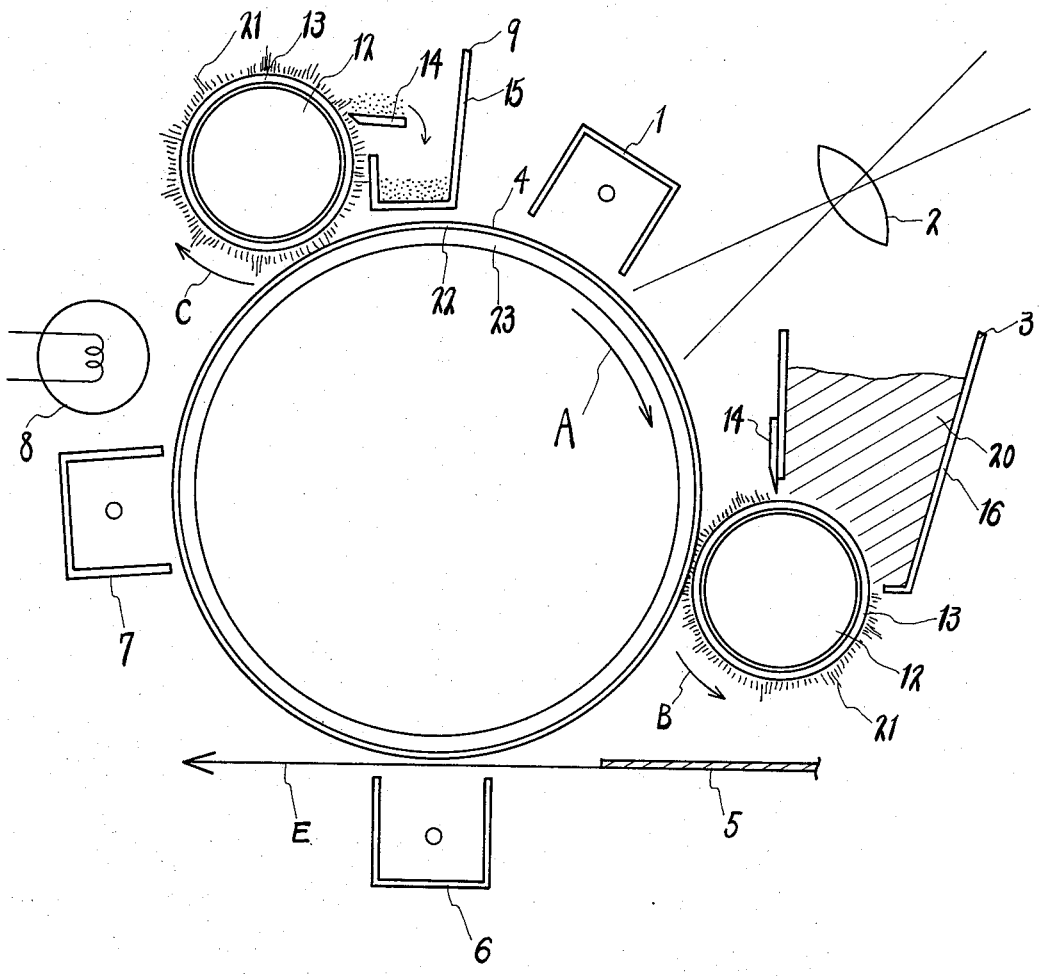
FIG. 1 is a schematic diagram illustrating the cleaning method of this invention which employs a magnetic cleaning brush independent of a magnetic developing brush.

The method of this invention will be described below in detail with reference to embodiments shown in the drawings. First the method will be described as practiced by an apparatus which is adapted to make one copy by one revolution of a photoconductive member, namely which includes a magnetic cleaning brush and a magnetic developing brush separate from each other.

FIG. 1 shows a hollow cylindrical photoconductive member 4 having a photoconductive layer 22 covering the outer surface of a conductive base 23 and rotatable in the direction of the arrow A. Provided around the photoconductive member 4 are a sensitizing corona charger 1, an image exposure unit 2, a developing unit 3, a transfer corona charger 6, a cleaning corona charger 7, a cleaning lamp 8 and a cleaning unit 9. These devices are arranged in the direction of rotation A in the order mentioned.

The functions of the devices will be described with the rotation of the photoconductive member 4 to clarify the present method.

The corona charger 1 charges the photoconductive member 4 positively or negatively in accordance with the photoelectric characteristics of the photoconductive member. Although the photoconductive member 4 will be described below as being negatively charged, the operation proceeds similarly when it is positively charged except that every polarity involved will then be opposite.

Subsequently the image exposure unit 2 projects an optical image of the original onto the surface of the photoconductive member 4 and forms an electrostatic latent image thereon.

Figure 7:
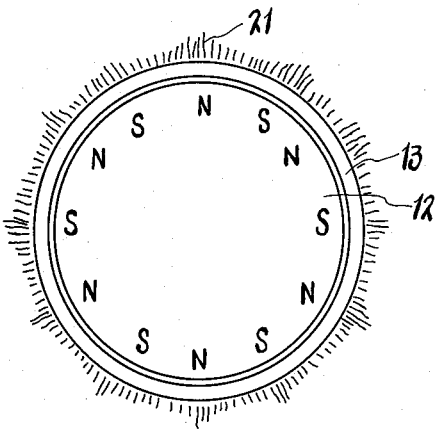
FIG. 7 is a diagram showing the magnetic brush.

The latent image is then developed by the developing unit 3 having the following construction. A toner container 16 contains a polarizable magnetic toner 20. Under the bottom of the container 16, there is provided a solid cylindrical magnet 12 covered with a rotatable nonmagnetic sleeve 13 in the form of a hollow cylinder having a small wall thickness. The toner 20 in the container 16 is attracted to the surface of the sleeve 13 by the force of the magnet 12, forming a magnetic brush 21 which rotates which the rotation of the sleeve 13. The magnet 12 has N poles and S poles alternately arranged along its outer periphery as illustrated in FIG. 7, so that the magnetic brush 21 has a larger thickness at these pole portions than at the other portions. Although the sleeve 13 is rotatable with the brush 21 in the direction of the arrow B in FIG. 1 relative to the stationary magnet 12, the magnet may alternatively be made rotatable relative to a fixed hollow cylindrical sleeve. The magnetic brush 21 is adjusted to a specified thickness by a blade 14 disposed on one side of the toner container 16.

The magnetic brush 21, by virtue of its rotation, brushes the surface of the photoconductive member 4 bearing the electrostatic latent image formed by the exposure unit 2, whereby the toner 20 providing the magnetic brush 21 is polarized in accordance with the charges forming the electrostatic latent image on the photoconductive surface. Consequently toner particles are deposited on the surface of the photoconductive member by the electrostatic attracting force between the particles and the photoconductive surface against the magnetic force of the developing unit 3, thus visualizing the latent image.

In timed relation to the rotation of the photoconductive member 4, transfer paper 5 is conveyed in the direction of the arrow E into intimate contact with the surface of the photoconductive member 4 and passed between the photoconductive member 4 and the transfer corona charger 6. At this time, the corona charger 6 negatively charges the transfer paper 5 over the rear surface thereof, whereby the toner image on the surface of the photoconductive member 4 is attracted and transferred to the paper 5.

The transfer paper 5 is fed to a fixing unit (not shown) to provide a finished copy.

Although the toner particles 20 on the surface of the photoconductive member 4 are predominantly transferred onto the paper 5, a small amount of particles will remain thereon.

Figure 2:
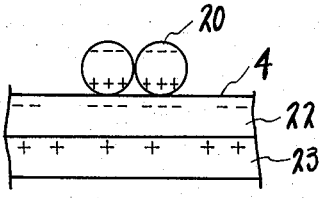
FIG. 2 is a diagram illustrating charges on a photoconductive member and toner particles remaining thereon after the transfer of toner images and to be removed by the method of this invention.

FIG. 2 shows charges on residual toner particles 20 and on the surface of the member 4. The toner particles 20 are polarized and held attracted to the negatively charged photoconductive layer 22 on the photoconductive member 4. In opposed relation to the negative charges on the photoconductive layer 22, positive charges are induced on the conductive base 23 beneath the layer 22 of the photoconductive member 4. To separate from the surface of the photoconductive member 4 the toner particles 20 remaining thereon immediately after the image transfer, there arises the necessity of fully reducing the electrostatic attraction between the toner particles 20 and the photoconductive layer 22.

Figure 3:
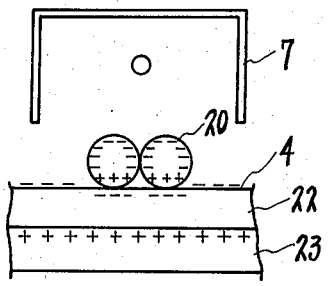
FIG. 3 is a diagram showing the photoconductive member and toner particles in FIG. 2 after a cleaning corona charge of the same polarity as the sensitizing charge has been given thereto according to the present method.

For this purpose, the cleaning corona charger 7 and cleaning lamp 8 are provided as will be described below. The charger 7 gives corona charges after the transfer. FIG. 3 shows the resulting charges on the residual toner particles 20 and photoconductive member 4. Stated more specifically, the charger 7 which gives charges of the same polarity as sensitizing corona charges, namely negative charges, imparts an increased amount of negative charges to the upper surfaces of the toner particles 20 (FIG. 3) and an increased amount of negative charges also to the surface of the photoconductive layer 22 at the portion thereof where no toner particles 20 are deposited, while permitting the layer 22 to retain negative charges at positions close to the deposited toner particles 20. The conductive base 23 has positive charges induced by the negative charges on the photoconductive layer 22.

In the state of FIG. 3 resulting from the cleaning corona charge, the increased amount of negative charges on the toner particles 20 has greatly reduced the electrostatic attraction present between the particles 20 and the layer 22 in the state of FIG. 2 immediately after the transfer. However, the photoconductive layer 22, which is negatively charged at the surface portion free of the deposition of the residual toner particles 20, will not be cleaned if it is brought close to the magnetic brush 21 of the cleaning unit 9 to be described below since toner particles 20 on the surface of the brush 21 will be thereby polarized and attracted to the photoconductive layer 22, thus adding to the amount of toner on the photoconductive member 4.

Figure 4:
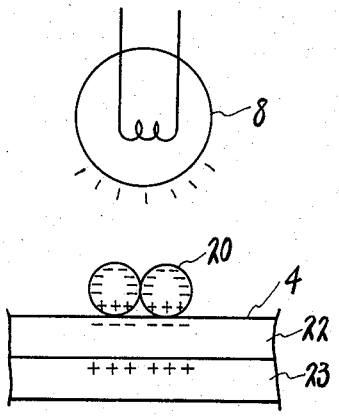
FIG. 4 is a diagram showing the photoconductive member and toner particles in FIG. 3 after having been uniformly exposed according to the present method.

Accordingly the photoconductive layer 22 is uniformly exposed by the cleaning lamp 8 after the corona charging. FIG. 4 shows the resulting charges on the residual toner particles 20 and on the surface of the photoconductive member 4. By virtue of the uniform exposure by the lamp 8, the negative charges on the layer 22 where it is free from toner particles 20 are neutralized with positive charges on the conductive base 23 and thereby eliminated from the surface. The surface of the layer 22 remains negatively charged where it bears the toner particles 20.

The cleaning unit 9 has the same construction as the developing unit 3 described and comprises a sleeve 13 formed with a magnetic brush 21 on its surface. The magnetic brush 21 rotates with the rotation of the sleeve 13 in the direction of the arrow C in FIG. 1 while brushing the surface of the photoconductive member 4, without permitting the brush forming toner particles to be attracted to the photoconductive member 4. The residual toner particles 20 on the surface of the photoconductive member 4 are magnetically attracted to the brush 21 against the electrostatic attraction between the particles and the layer 22.

The layer of toner 20 on the sleeve 13 is maintained at a specified thickness by a blade 14. The excess of toner is placed into a container 15.

The cleaning unit 9 needs only to be means which is capable of magnetically removing the residual toner 20 from the surface of the photoconductive member 4.

The uniform exposure which is conducted after the corona charging in the foregoing embodiment may alternatively be effected simultaneously with the corona charging.

However, if the uniform exposure precedes the corona charging, the photoconductive layer 22 will be charged, attracting toner particles on the magnetic cleaning brush 21 as described above, and will not be cleaned.

The cleaning corona charges must be of the same polarity as the sensitizing corona charges for the following reason.

Figure 5:
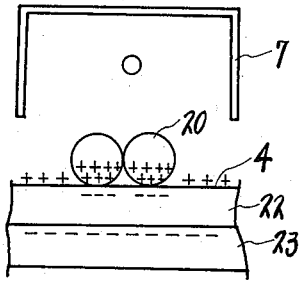
FIG. 5 is a diagram showing the photoconductive member and toner particles in the state of FIG. 2 after a corona charge of polarity opposite to that of the sensitizing charge has been given thereto.

FIG. 5 shows the residual toner particles 20 and the photoconductive member 4 in the state immediately after the transfer (FIG. 2) after they have been given cleaning corona charges of polarity opposite to that of the sensitizing corona charges, namely positive charges. It is seen that the toner particles 20 are wholly positively charged and that the photoconductive layer 22 is also positively charged except where the toner is deposited on its surface. The portions of the photoconductive surface bearing the toner particles 20 remain negatively charged, with the conductive base also negatively charged entirely.

Figure 6:
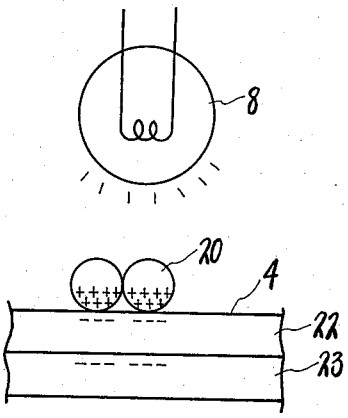
FIG. 6 is a diagram showing the photoconductive member and toner particles in FIG. 5 after having been uniformly exposed.

Thus the electrostatic attraction between the toner particles 20 and the photoconductive member 4 has been increased in corresponding relation to the increment of the positive charges on the toner 20. FIG. 6 shows the residual toner 20 and the photoconductive surface 22 in this state after they have been uniformly exposed by the cleaning lamp 8. From the surface of the photoconductive member the positive charges have been eliminated by being neutralized with negative charges on the conductive base 23 except where the toner 20 is deposited. The toner bearing surface portions remain charged as before. As in the state of FIG. 5, the electrostatic attraction between the toner particles 20 and the photoconductive layer 22 has been increased in corresponding relation to the increment of the positive charges on the toner 20. Consequently the residual toner is not removable from the surface of the photoconductive member.

Figure 8:
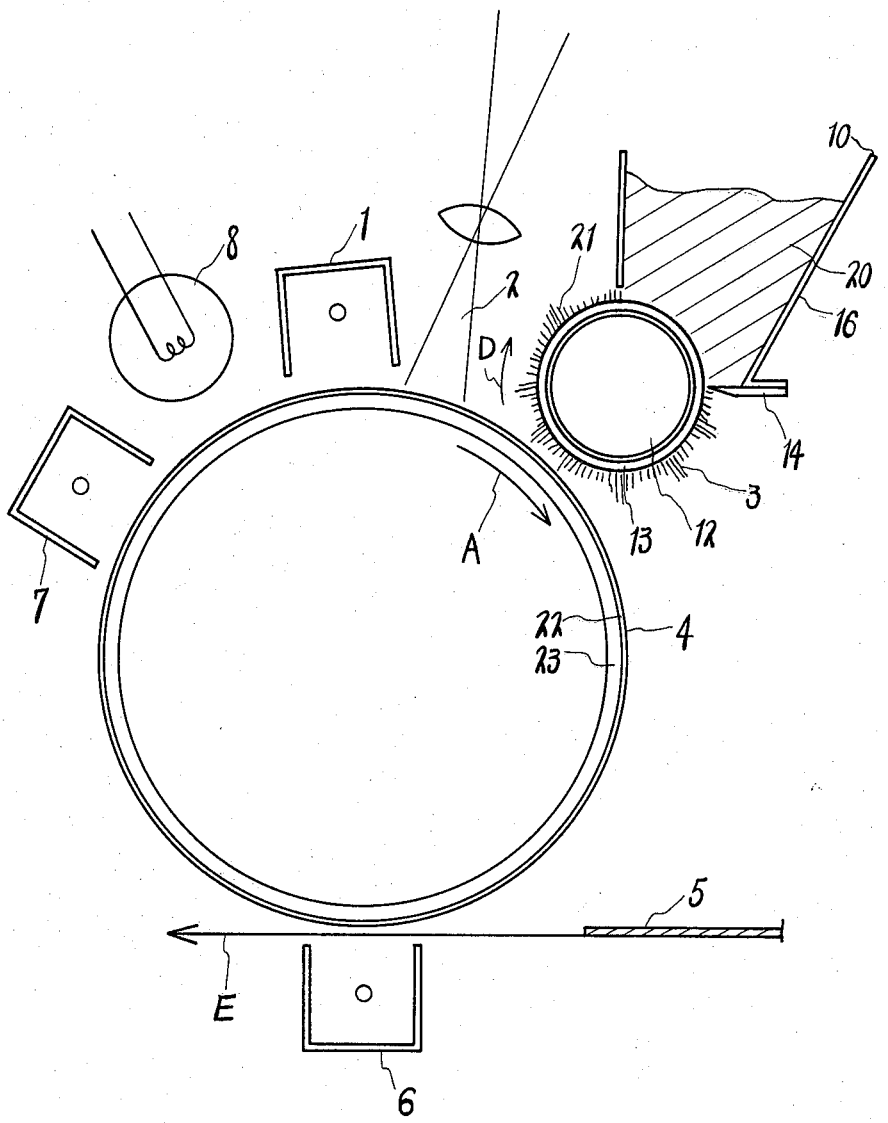
FIG. 8 is a schematic diagram showing the cleaning method of this invention which employs a magnetic developing brush as a cleaning brush.

With reference to FIG. 8, the cleaning method of this invention will further be described below as it is practiced with use of an apparatus which is adapted to give a copy by two revolutions of the photoconductive member, namely which includes a magnetic developing brush serviceable also as a cleaning brush.

During the first revolution of the photoconductive member 4, the photoconductive member is charged by a sensitizing corona charger 1 for example negatively and thereafter subjected to the operations of an image exposure unit 2, a developing-cleaning unit 10 (for development), a transfer corona charger 6 and a cleaning corona charger 7. The photoconductive member 4 is then uniformly exposed by a cleaning lamp 8.

During the subsequent revolution of the photoconductive member 4, the sensitizing charger 1 and exposure unit 2 are off, and the developing-cleaning unit 10 removes the residual toner 20 from the photoconductive member 4 for cleaning. The photoconductive member 4 rotates to and stops at the start position.

Examples of the invention are given below.

EXAMPLE 1

The photoconductive member 4 used had a photoconductive layer of poly-N-vinylcarbazole having enhanced sensitivity given by tetranitrofluorenone. The photoconductive member 4 was subjected to a negative corona discharge of 7 KV by the sensitizing corona charger 1 to charge the photoconductive surface negatively to about 300 V. An electrostatic latent image corresponding to the original to be copied was formed on the sensitized surface by the image exposure unit 2. The latent image was converted by the magnetic brush 21 of the developing unit 3 to a toner image, which was then transferred onto copy paper 5 sent forward in timed relation to the photoconductive member 4 and subjected on its rear surface (nontransfer face) to a negative corona discharge of 5.2 KV by the transfer corona charger. The toner remaining on the photoconductive member 4 after the image transfer was given a negative charge of 5.2 KV by the cleaning corona charger 7 and was thereafter uniformly exposed by a 10-W white fluorescent lamp used as the cleaning lamp 8. When brought to the magnetic brush 21 of the cleaning unit 9, the residual toner was completely removed from the photoconductive surface.

The toner used was a single-component magnetic toner, 2 to 44 microns in particle size, prepared by dispersing an epoxy resin, ferrosoferric oxide and carbon black in a solvent, spray-drying the dispersion and screening the resulting product. The toner had an electric resistivity of $1.3\times10^{10}$ Ω cm (voltage applied: 400 V/cm).

EXAMPLE 2

Image forming, transferring and cleaning operations were conducted in the same manner as in Example 1 except that sensitized zinc oxide was used for the photoconductive layer. The residual toner was fully removed from the photoconductive surface.

EXAMPLE 3

Image forming, transferring and cleaning operations were conducted in the same manner as in Example 1 except that selenium was used for the photoconductive layer and that the charges applied were all of positive polarity. The residual toner was fully removed from the photoconductive surface.

What is claimed is:

1. In an electrostatic copying process of the type including providing a photoconductive member having a photoconductive surface over a conductive base, sensitizing said photoconductive surface by charging said photoconductive surface to a given polarity, exposing the thus charged surface to an optical image and thereby forming an electrostatic latent image on said photoconductive surface, developing said electrostatic latent image by means of a singlecomponent magnetic toner including toner particles which are polarizable in an electric field, such that said toner particles are polarized in accordance with charges forming said electrostatic latent image and are deposited on said surface by an electrostatic attraction force between said toner particles and said surface to thereby form a toner image on said surface, transferring said toner image to a copy paper, and thereafter cleaning from said surface any residual toner particles remaining after said transfer, the improvement wherein said cleaning comprises:

subjecting said surface and said residual toner particles to a charge of the same polarity as said given polarity, thereby increasing the charge of said given polarity on outer portions of said residual toner particles and on portions of said surface not covered by said residual toner particles, and thereby inducing in said conductive base a charge of the opposite polarity from said given polarity;

uniformly exposing said surface, simultaneously with or after said step of subjecting, and thereby neutralizing said charge of said given polarity on said portions of said surface not covered by said residual toner particles with said charge of opposite polarity in said conductive base;

whereby there is achieved an electrical neutralization over the entire area of said surface and said residual toner particles and a reduction of said electrostatic attraction force between said residual toner particles and said surface; and removing said residual toner particles from said surface by brushing said surface with a magnetic brush formed of a single-component magnetic toner including toner particles which are polarizable in an electric field, and magnetically attracting to said magnetic brush said residual toner particles from said surface against the reduced electrostatic attraction force therebetween, while preventing polarization of said toner particles forming said magnetic brush due to said electrical neutralization.

2. The improvement claimed in claim 1, wherein said step of subjecting is achieved by a corona charger.

3. The improvement claimed in claim 1, further comprising moving said magnetic brush and said photoconductive surface in opposite contacting directions.

4. The improvement claimed in claim 1, further comprising employing said magnetic brush as means for achieving said step of developing.

* * * * *